US008991665B2

(12) United States Patent
Blaufeld

(10) Patent No.: US 8,991,665 B2
(45) Date of Patent: Mar. 31, 2015

(54) GARMENT HOLDING AND SHAPE SAVING APPARATUS

(71) Applicant: Rachel H. Blaufeld, Pittsburgh, PA (US)

(72) Inventor: Rachel H. Blaufeld, Pittsburgh, PA (US)

( * ) Notice: Subject to any disclaimer, the term of this patent is extended or adjusted under 35 U.S.C. 154(b) by 0 days.

(21) Appl. No.: 14/186,541

(22) Filed: Feb. 21, 2014

(65) Prior Publication Data

US 2014/0299637 A1 Oct. 9, 2014

Related U.S. Application Data

(60) Provisional application No. 61/767,475, filed on Feb. 21, 2013.

(51) Int. Cl.
*D06C 15/00* (2006.01)
*A47F 7/19* (2006.01)

(52) U.S. Cl.
CPC ..... *A47F 7/19* (2013.01)
USPC ..... 223/66; 223/84

(58) Field of Classification Search
CPC ..... A47G 25/20; A47G 2025/1492; A47G 25/441; D06F 95/006; D06F 95/008; D06F 59/02; B65D 85/18; A47F 8/00; A47F 8/02
USPC ..... 223/66, 84, 85
See application file for complete search history.

(56) References Cited

U.S. PATENT DOCUMENTS

| | | | | |
|---|---|---|---|---|
| 2,730,275 | A * | 1/1956 | Flores | 223/66 |
| 2,756,911 | A * | 7/1956 | Kantor et al. | 223/68 |
| 2,815,157 | A * | 12/1957 | Badgley | 223/66 |
| 2,866,583 | A | 12/1958 | Batts | |
| 2,951,621 | A | 9/1960 | Cheney | |
| 3,085,723 | A * | 4/1963 | Vanderburg | 223/66 |
| 3,176,686 | A | 4/1965 | Barnes | |
| 3,346,149 | A * | 10/1967 | Tiss | 223/66 |
| 3,837,476 | A * | 9/1974 | Schwartz | 206/45.24 |
| 5,078,307 | A | 1/1992 | Suddath | |
| 5,556,013 | A | 9/1996 | Mayer | |
| 5,971,236 | A | 10/1999 | DesForges et al. | |
| 6,471,102 | B2 * | 10/2002 | Hancock | 223/84 |
| 6,761,291 | B2 | 7/2004 | Moskovitz et al. | |
| 7,163,605 | B2 | 1/2007 | Chen | |
| 7,252,573 | B2 * | 8/2007 | Mann | 223/66 |
| 7,350,679 | B2 * | 4/2008 | Radtke et al. | 223/84 |
| 7,743,953 | B2 * | 6/2010 | Okazaki et al. | 223/84 |
| 7,922,046 | B2 * | 4/2011 | Radtke et al. | 223/84 |
| 2006/0086740 | A1 | 4/2006 | Troha et al. | |
| 2007/0210124 | A1 | 9/2007 | Dikes | |
| 2008/0237071 | A1 | 10/2008 | Campillo et al. | |
| 2008/0289978 | A1 | 11/2008 | Malick | |
| 2009/0266851 | A1 * | 10/2009 | Perlman et al. | 223/84 |
| 2012/0199618 | A1 * | 8/2012 | Doyle | 223/85 |

FOREIGN PATENT DOCUMENTS

| | | |
|---|---|---|
| JP | 2004 60100 | 2/2004 |

* cited by examiner

*Primary Examiner* — Nathan Durham
(74) *Attorney, Agent, or Firm* — The Webb Law Firm

(57) ABSTRACT

An apparatus used to store and/or display garments, such as brassieres, is provided. The device includes a first semispherical cup, a second semispherical cup, and a connecting member. The connecting member is used to interconnect the first and second cups. The connecting member allows for the spacing between the first and second cups to be adjusted. Also provided are methods of using the apparatus to store and/or display garments.

16 Claims, 10 Drawing Sheets

GARMENT HOLDING AND SHAPE SAVING APPARATUS

CROSS REFERENCE TO RELATED APPLICATION

This application claims priority to U.S. Provisional Patent Application No. 61/767,475 filed Feb. 21, 2013, the entire contents of which are herein incorporated by reference.

BACKGROUND OF THE INVENTION

1. Field of the Invention

This invention relates to an apparatus for holding garments. More particularly, this invention relates to an apparatus for holding and preserving the shape of a brassiere, as well as methods of use thereof.

2. Description of Related Art

Devices to hold and display articles of clothing are common and include items such as hangers, mannequins, and display racks. These items can present the garment for display purposes as well as offer a place for storing the garment when the garment is not in use.

One particular type of garment that is occasionally associated with such display items is a woman's brassiere. A woman's brassiere, as is commonly understood, includes a pair of cups connected to one another and a series of straps extending from each of the cups which can be clasped in the back when the brassiere is being worn. Some brassieres also include an underwire to help retain the shape of the cups, while others do not.

Brassieres are occasionally displayed in retail establishments using a mannequin or other display apparatus that is intended to simulate an actual wearer of the brassiere. However, at home, brassieres are often not given the same level of care and may be simply placed in a drawer along with numerous other items. The same is true of brassieres in retail establishments that are not on one of the mannequin displays.

When brassieres are not given proper care during storage, the shape of the cups can be compromised. This can cause the brassiere to exhibit an undesirable appearance when worn or, in extreme cases, render the brassiere unusable altogether. Misshaping of the cup portions of a brassiere often occurs because there is insufficient support provided for the cup during storage and a heavier item that is placed on the brassiere simply deforms the material and/or underwire that provided the cup its shape in the first instance.

Articles exist for maintaining the shape of a brassiere during storage. For example, United States Patent Application No. 2009/0266851 to Perlman et al. provides an article for maintaining the shape of a brassiere that includes two rounded portions, each of which accepts one cup of the brassiere. By way of another example, United States Patent Application No. 2008/0237071 to Campillo et al. provides a protective lingerie case with internal protuberances designed to hold the cups of a brassiere. In addition, U.S. Pat. No. 7,252,573 to Maim provides a frame for maintaining the shape of a brassiere during drying and storage that includes a pair of hemispherically-shaped shells with apertures formed therethrough.

However, these existing articles fail to provide an apparatus that can be used for storing and displaying brassieres in a simple and elegant way and which can be adapted to be used with brassieres of different sizes.

SUMMARY OF THE INVENTION

Provided is an apparatus for holding garments in a manner that preserves the shape of the garment. The device can include a first semispherical cup, a second semispherical cup, and a connecting member. The connecting member interconnects the first cup and the second cup and allows for the spacing between the first cup and the second cup to be adjusted.

In certain non-limiting embodiments, the connecting member includes an elongated tongue member connected to or integrated with the first cup and a groove member connected to or integrated with second cup. The tongue member and the groove member are complementary with one another such that the tongue member can slide within the groove member to adjust the spacing between the first cup and the second cup.

In one non-limiting embodiment, the groove member can include a hinged member. Hinged member can pivot from a closed position to an open position about a hinge. When in the closed position, hinged member can form a groove within which the elongated member of the connecting member can slide.

In another non-limiting embodiment, the groove member has an elongated shape with a groove formed between a top side and a bottom side within which the elongated member can slide.

In another non-limiting embodiment, the connecting member can have one or more cup engagement portions along its length, each of which is designed to engage a complementary section of first cup or second cup. When first cup and second cup are each engaged with connecting member, an interconnection between the first cup or the second cup is established.

An object of the invention is to provide an apparatus which can hold a garment, and particularly a brassiere, in a manner that preserves the shape of the garment while the garment is being stored or on display. Another object of the invention is to provide an apparatus which can accept garments of different sizes and which can be configured to fit in locations of limited size, such as by adjusting the spacing between the first and second cups.

These and other objects and advantages of the invention will be apparent from the description provided herein.

DETAILED DESCRIPTION OF THE INVENTION

Figure 1:
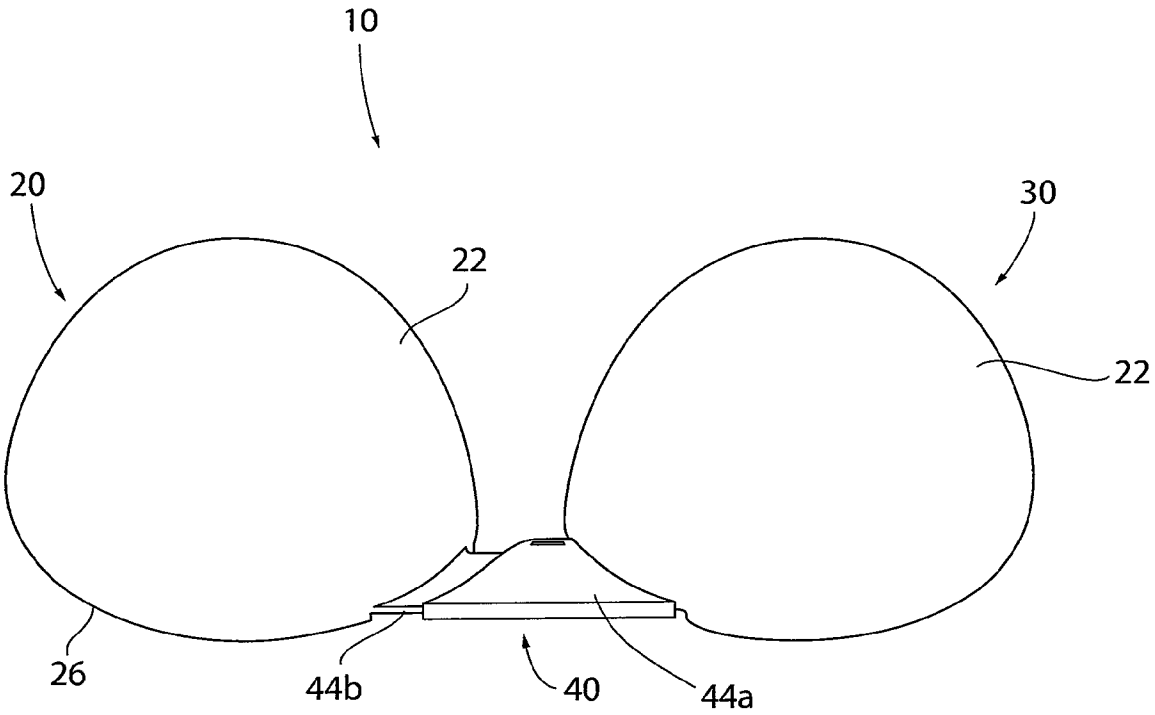
FIG. 1 is a perspective view showing one embodiment of the apparatus of the present invention.

As used herein, spatial or directional terms, such as "left," "right," "inner," "outer," "above," "below," "top," "bottom," and the like, relate to the apparatus as it is shown in FIG. 1. However, it is to be understood that the apparatus may assume various alternative orientations and, accordingly, such terms are not to be considered as limiting. Further, as used herein, all numbers expressing dimensions, physical characteristics, and the like, used in the specification and claims are to be understood as being modified in all instances by the term "about."

Disclosed is an apparatus that can be used to hold a garment, such as a brassiere, for purposes such as storage and/or display. The apparatus provides support for the garment and aids in retaining the garment's shape while the apparatus is being used to hold the garment. Also disclosed are methods of using an apparatus as described herein in connection with storing and/or displaying a garment.

Reference is now made to FIGS. 1-5, which show one non-limiting embodiment of a garment holding and shape saving apparatus 10 according to the present disclosure.

Apparatus 10 includes a first cup 20, a second cup 30, and a connecting member 40 that extends between first cup 20 and second cup 30. In some non-limiting embodiments, first cup 20, second cup 30, and connecting member 40 are separate parts that can be connected to one another for use, as explained below. In other non-limiting embodiments, first cup 20, second cup 30, and/or connecting member 40 may be integrally formed with one another as a unitary structure or otherwise permanently affixed to one another. For example, first cup 20 may be integrally formed with connecting member 40 as a single unitary structure while second cup 30 may be provided as a separate part, second cup 30 may be integrally formed with connecting member 40 as a single unitary structure while first cup 20 is provided as a separate part, or first cup 20, second cup 30, and connecting member 40 may all be integrally formed as a single unitary structure.

First cup 20 can be a generally semispherical shell that has an outer convex surface 22 and a peripheral edge 26. In one embodiment, shown in FIGS. 1-5, the shape of first cup 20 lies somewhere between a hemisphere and a quarter of a sphere, though either a hemisphere or a quarter of a sphere are contemplated shapes for first cup 20. Other shapes are envisioned as well. Shape of first cup 20 is dictated largely by the shape of the garment in connection with which apparatus 10 is intended to be used. For example, if garment is a brassiere, shape of first cup 20 should be selected to fit within and substantially fill the cup portion of the brassiere. A generally semispherical shape will typically work for this purpose. First cup 20 can also come in various sizes to fit brassieres of different cup sizes. First cup 20 can be shaped such that first cup 20 can rest on a portion of peripheral edge 26 which runs along the bottom of first cup 20 and remain in an upright position, such as shown in FIG. 1.

Figure 2:
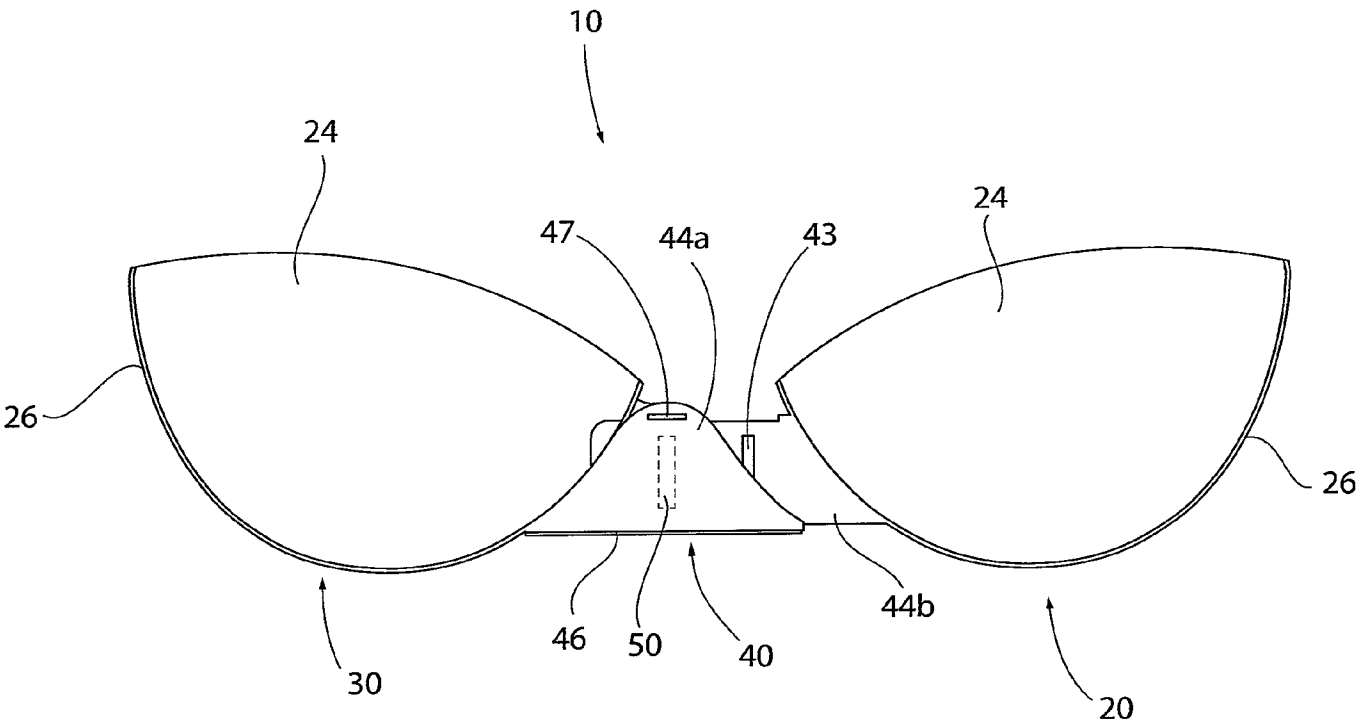
FIG. 2 is a bottom plan view of the embodiment shown in FIG. 1.
Figure 3:
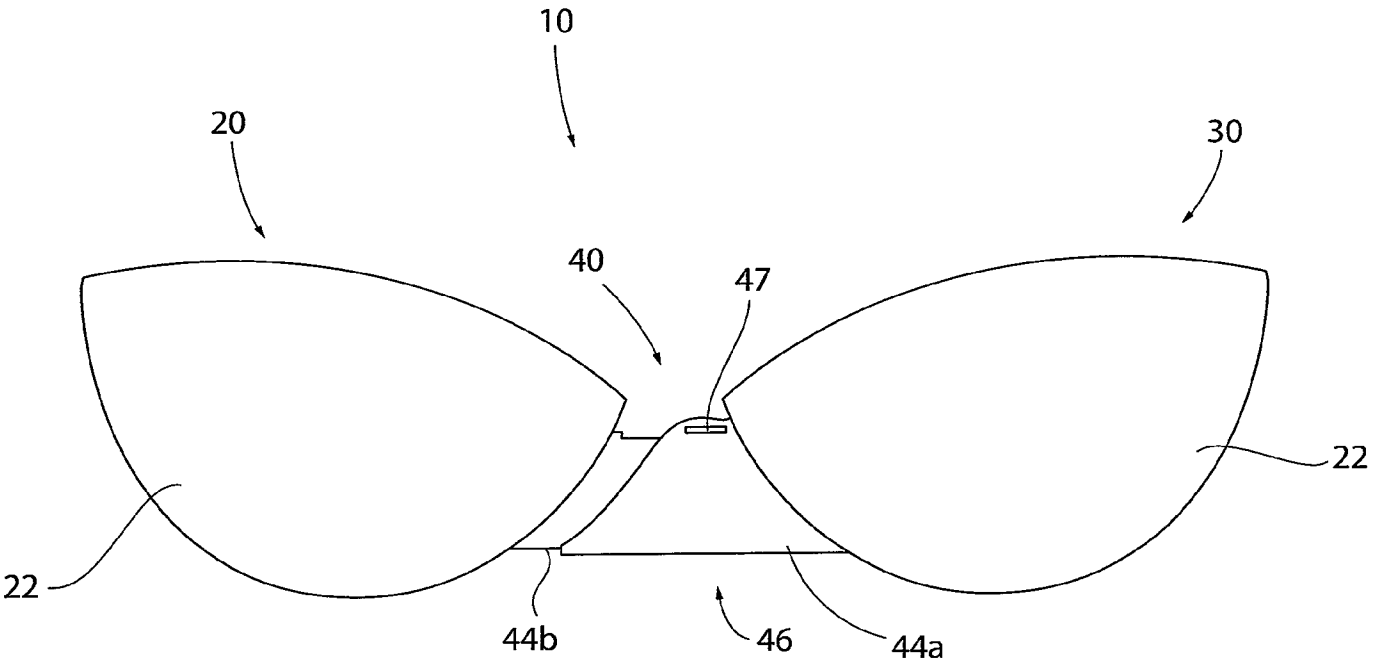
FIG. 3 is a top plan view of the embodiment shown in FIG. 1.
Figure 4:
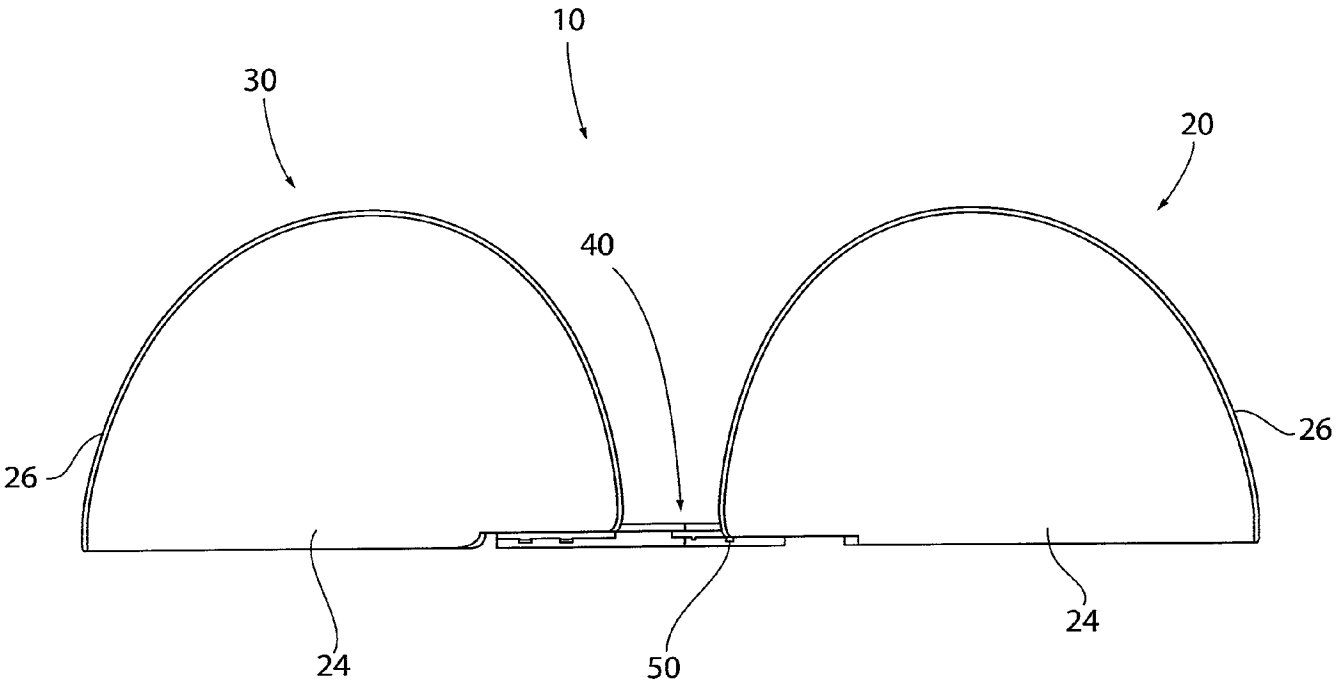
FIG. 4 is a rear perspective view of the embodiment shown in FIG. 1.

In some non-limiting embodiments, first cup 20 can have an inner concave surface 24 disposed opposite the outer convex surface 22 such that first cup 20 is essentially a hollow shell, as shown in FIGS. 2 and 4. The thickness of the shell is not limited, though it should be sufficiently thick to provide a rigid structure that can support one or more garments placed thereon and provide a level of protection consistent with the purposes described herein while also being sufficiently thin that the weight and manufacturing costs are minimized. For example, the hollow shell could be between 0.5 and 3 cm thick, such as 0.5 to 1.5 cm thick.

The configuration where first cup 20 is provided as a hollow shell provides certain advantages. For example, this allows first cup 20 and second cup (described below) to be stacked on top of one another when apparatus 10 is not in use to reduce the total footprint of apparatus for storage and/or packaging purposes. In addition, the straps of a brassiere can be folded around the peripheral edge 26 of first cup 20 and tucked into the hollow interior portion so that they are out of the way.

In other non-limiting embodiments, some or all of the inner portion of the shell can be filled with a material, such as the material which is used to form the remainder of first cup 20 or another suitable material, such as a foam material. This embodiment would allow added stability when first cup 20 is positioned on a flat surface by increasing the total area of first cup 20 that is in contact with the surface. In other non-limiting embodiments, at least the bottom section of peripheral edge 26, (e.g., the portion of peripheral edge 26 on which first cup 20 is intended to rest), can have a lip or rim disposed thereon to increase the stability of first cup 20 when first cup 20 is at rest on a surface.

First cup 20 can be composed of any material known in the art, including plastic, metal, rigid fabric, carbon fiber, rubber or any combination thereof. Preferably, first cup is formed of a polymeric material, such as polyethylene, polystyrene, polyethylene polypropylene, acrylonitrile butadiene styrene (ABS), polyvinyl chloride (PVC), and blends and copolymers thereof. In some non-limiting embodiments, first cup 20 can have a second material covering all or select portions of the outer surface 22. Second material can also encapsulate the entire cup 20. The second material can be a polymeric material, and preferably is a polymeric material that is softer than the material which forms the cup that provides added friction or grip to help secure the garment to the outer surface 22 and prevent the garment from slipping off of the surface. Non-limiting examples include elastomers, latex, and low durometer silicone, polypropylene, or urethane. Second material can be formed by flocking, in which small fiber particles are deposited on the outer and/or inner surfaces of first cup 20. Potentially useful flocking materials include natural materials such as cotton as well as synthetic materials such as nylon, and blends thereof.

Figure 6:
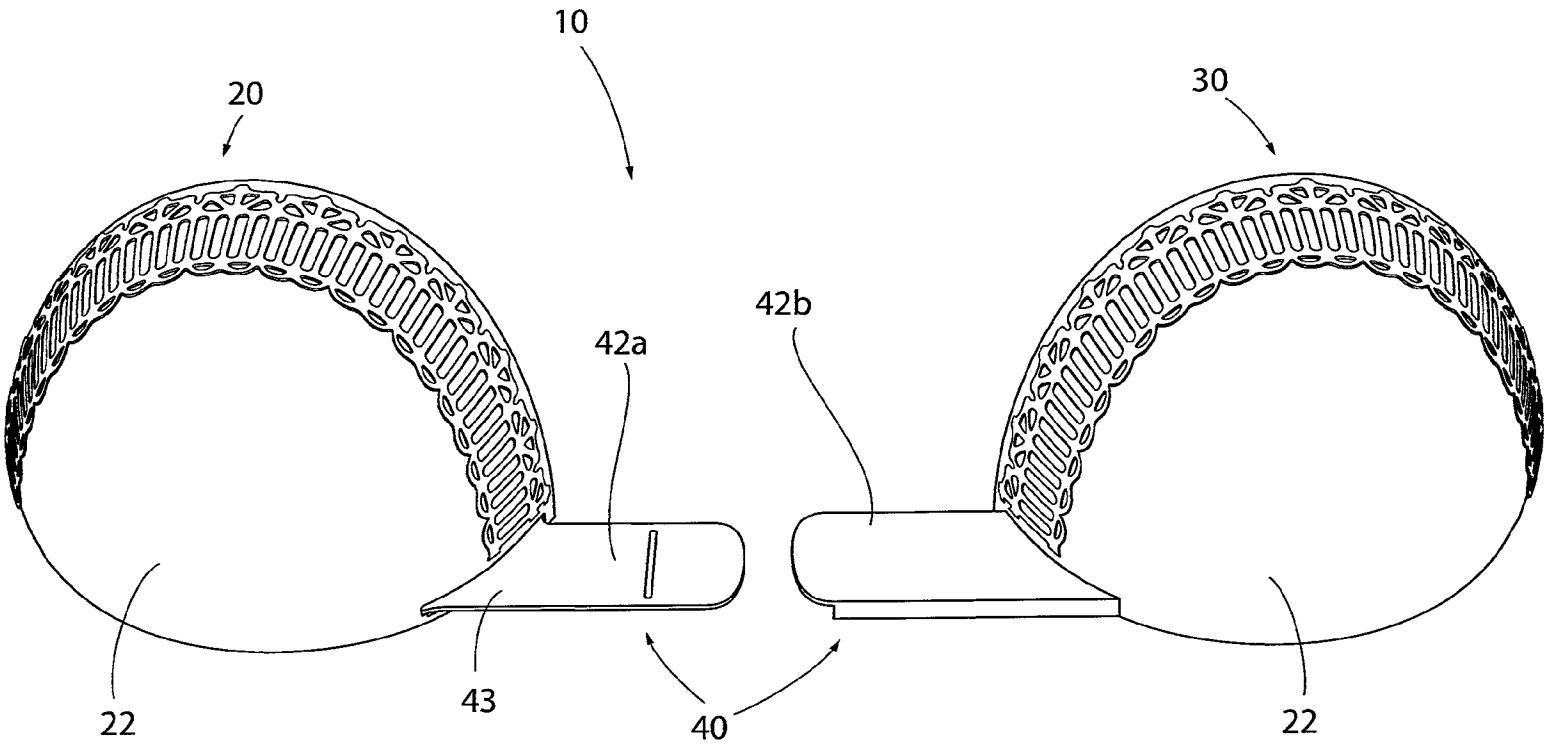
FIG. 6 is a perspective view showing a second embodiment of the apparatus of the present invention.

In some non-limiting embodiments, outer surface 22 is a smooth surface, such as shown in FIG. 1. However, outer surface 22 can have a pattern, such as a lace-like pattern disposed thereon, such as shown in FIG. 6. The pattern can be integrally formed with first cup 20 during, for example, the molding process or a pattern can be an overmold that is applied to the already-formed first cup 20 such as by applying a material on the outer surface 22 of first cup 20 in the desired pattern. The pattern can also be formed as a separate piece and then affixed to outer surface 22, such as by using an adhesive material. A second polymeric material, including those discussed above, can be dispersed onto the outer surface 22 of first cup 20 to create a pattern. Such a pattern can improve the overall appearance of first cup 20 and may also create additional friction between first cup 20 and the garment to help secure the garment to first cup 20. Flocking, as described above, can also increase the friction between first cup 20 and the garment.

Second cup 30 can be of the same general shape and size as first cup 20 and composed of the same material as first cup 20, including the same second material. Preferably, first cup 20 and second cup 30 are mirror images of one another, such that second cup 30 is of the same shape and size as first cup 20, though certain features of the respective first and second cups 20, 30 are disposed on opposite sides. For example, if first and second cups 20, 30 are each placed with their respective convex outer surfaces facing the same direction, as in FIG. 1, the portion of first cup 20 which engages with connecting member 40 would be on the right, when viewed straight on, while the portion of second cup 30 which engages with connecting member 40 would be on the left. A reason for this is apparent from FIG. 1, wherein the connecting member 40 is extends between the first and second cups 20, 30.

As mentioned above, apparatus 10 can further include a connecting member 40. Connecting member 40 is designed to interconnect first cup 20 with second cup 30. Preferably, connecting member 40 can form a sufficiently rigid connection between first cup 20 and second cup 30 to retain first cup 20 a set distance from second cup 30, though this set distance can be adjusted, as explained below. In some non-limiting embodiments, connecting member 40 can be a separate piece from both first cup 20 and second cup 30. In other non-limiting embodiments, connecting member 40 can be integrally formed with or permanently affixed to either first cup 20, second cup 30, or both. Connecting member 40 can also be comprised of more than one piece, such as a first piece which extends from or is otherwise associated with first cup 20 and a second piece which extends from or is otherwise associated with second cup 30. The first and second pieces of connecting member 40 can then engage with one another to form a connection between first cup 20 and second cup 30. In certain preferred embodiments, connection member 40 can include a tongue member and a complementary groove member where the tongue member and groove member engage with one another. Connecting member 40 can be formed from any suitable material, including those materials mentioned above in connection with first cup 20. Preferably, connecting member 40 is formed of a rigid plastic.

In one non-limiting embodiment, shown in FIGS. 1-5, connecting member 40 can include a groove member in the form of a hinged member 44*a* which is integrally formed with or otherwise connected with first cup 20 and a tongue member in the form of an elongated member 44*b* which is integrally formed with or otherwise connected to second cup 30. Hinged member 44*a* can have a top surface and a bottom surface. One of the top surface and bottom surface can be connected to first cup 20 while the other can pivot from a closed position, shown in FIGS. 1-5, to an open position about hinge 46. Hinged member 44*a* can further include a locking mechanism 47 to secure hinged member 44*a* in the closed position. In the closed position, hinged member 44*a* forms a groove. Hinged member 44*a* can include a notch 50 (shown in phantom in FIG. 2) or series of notches on the underside of the top surface or the topside of the bottom surface. These notches are designed to engage a tab 43 or series of tabs on the top or bottom surface of elongated member 44*b*. For instance, when hinged member 44*a* is in the closed position, thereby forming a groove, elongated member 44*b* can be slide into the groove formed by hinged member 44*a* such that a tab 43 on elongated member 44*b* engages with a notch 50 on hinged member 44*a*. When tab 43 is engaged with the notch 50, elongated member 44*b* is secured in place relative to hinged member 44*a*, thereby interconnecting first cup 20 and second cup 30 at a set distance from one another.

Figure 5A:
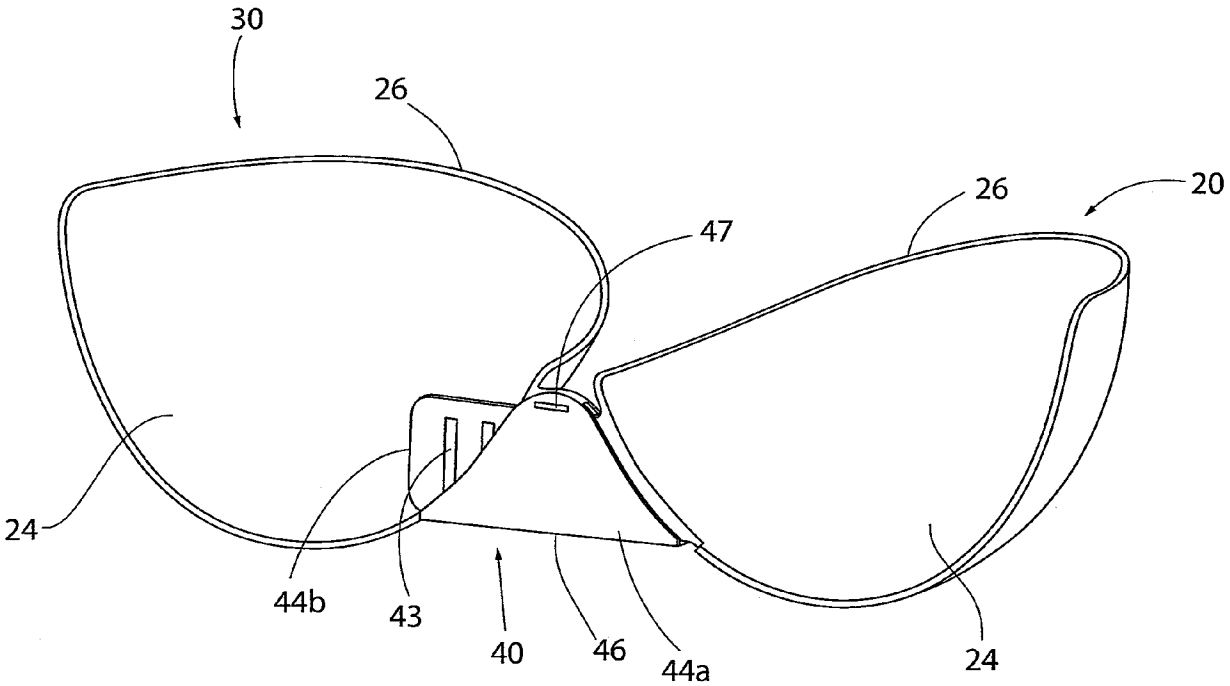
FIG. 5*a-c* are perspective views showing the embodiment of FIG. 1 with the cups spaced various distances from one another.
Figure 5B:
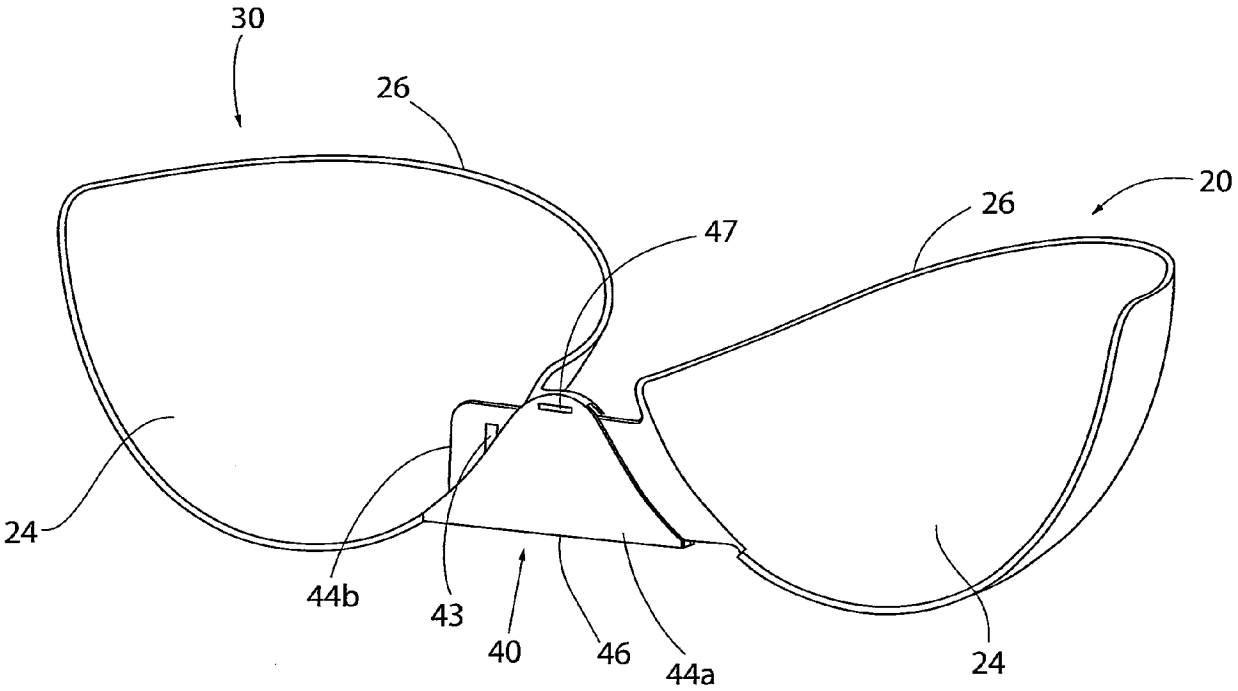
Figure 5C:
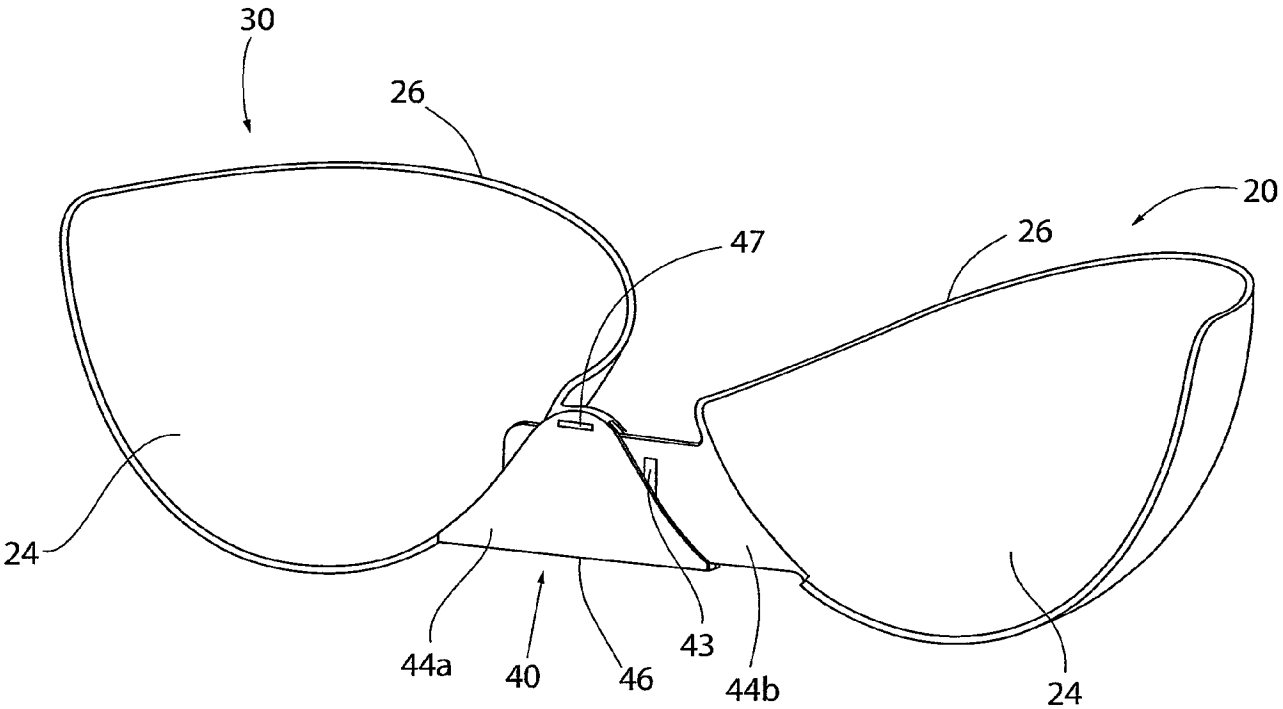

Elongated member 44*b* can include one or more tabs 43 located along its length, each of which can engage the notch 50 of hinged member 44*a*, thereby allowing hinged member 44*a* to engage elongated member 44*b* at different positions along the length of elongated member 44*b* in order to adjust the spacing between first cup 20 and second cup 30. For example, FIG. 5*a* shows hinged member 44*a* engaging elongated member 44*b* at a first position, FIG. 5*b* shows hinged member 44*a* engaging elongated member 44*b* at a second position, and FIG. 5*c* shows hinged member 44*a* engaging elongated member 44*b* at a third position. Each of these positions configures first cup 20 a different distance from second cup 30. Alternatively, elongated portion 44*b* can include one or more notches while hinged member 44*a* can include a tab which engages the notches.

In operation, a force can be applied to elongated member 44*b* to slide elongated member 44*b* to the desired position within hinged member 44*a*. When a different relative positioning of first and second cups 20, 22 is desired, elongated member 44*b* can be slid outward or inward relative to hinged member 44*a* until the desired spacing is achieved. The size of the tabs 43 and the depth of notches 50 should complement one another such that tabs 43 fit securely within notches. The relative sizing of tabs 43 and notches should be sufficient to create a frictional force between elongated member 44*b* and hinged member 44*a* such that the first cup 20 and second cup 24 can be maintained at a fixed distance when the apparatus 10 is in use without moving relative to one another in response to minor forces being applied to either cup. However, the relative sizing of tabs and notches should not be so great that the elongated member 44*b* cannot be easily slide within hinged member 44*a* by a human. In some non-limiting embodiments, squeezing of the sides of hinged member 44*b* can increase the size of the groove and enable elongated member 44*b* to slide more easily within the groove.

In another embodiment, hinged member 44*a* can be opened, elongated member 44*b* can be placed within hinged member 44*a* such that tab 43 is aligned with the notch and then hinged member 44*a* can be closed and secured in the closed position using locking mechanism 47. To adjust the spacing between first and second cups 20, 30, this process can be repeated using a different tab 43.

Hinged member 44*a* can be designed such that the locking mechanism 47 permanently configures hinged member 44*a* in the closed position. This provides an advantage in that the hinged member 44*a* can be manufactured in the open position and then closed prior to use to form the groove. This design may provide certain manufacturing efficiencies over forming a groove member in the first instance.

In another non-limiting embodiment, shown in FIG. 6, connecting member 40 can include a first elongated member 42*a* connected to or integrated with first cup 20 and a second elongated member 42*b* connected to or integrated with second cup 30. First and second elongated member 42*a-b* can interface with one another in a tongue and groove or other suitable arrangement in order to secure first elongated member 42*a* to second elongated member 42*b* and thereby interconnect first cup 20 with second cup 30. First elongated member 20 can include a top surface with a tab 43 thereon which can engage a corresponding notch (not shown, but similar to notch 50) within the groove of second elongated member 42*b* to secure first and second elongated members 42*a-b* to one another. Second elongated member 42*b* can include a series of notches therein which allow first elongated member 42*a* to engage second elongated member 42*b* at various points in order to adjust the space between first and second cups 20, 30. Alternatively, first elongated member 42*a* can include a series of tabs thereon which allow first elongated member 42*a* to engage second elongated member 42*b* at various points. The distance between first and second cups 20, 30 can be adjusted by sliding first elongated member 42*a* further within second elongated member 42*b* or retracting first elongated member 42*a* from second elongated member 42*b*. Alternatively, tab 43 can be disposed on bottom surface of first elongated member 42*a* or first elongated member 42*a* can have a notch on either a top or bottom surface which interacts with a tab 43 or series of tabs within second elongated member 42*b*.

In some non-limiting embodiments, rather than, or in addition to, notch(es) and corresponding tab(s) 43, the first and second pieces of connecting member 40 may be held in place relative to one another using friction. For example, at least one of the outer surface of the tongue member and the inner surface of the groove member may have a friction enhancing agent, such as one of the second polymeric or flocking materials described above. In some embodiments, the friction enhancing agent may completely cover these surfaces while in other embodiments the friction enhancing agent may partially cover these surfaces, such as in the form of strips or a pattern. When the tongue is then inserted into the groove, the friction enhancing agent creates friction between the two pieces, allowing the tongue to stay relatively in place within the groove.

Figure 7:
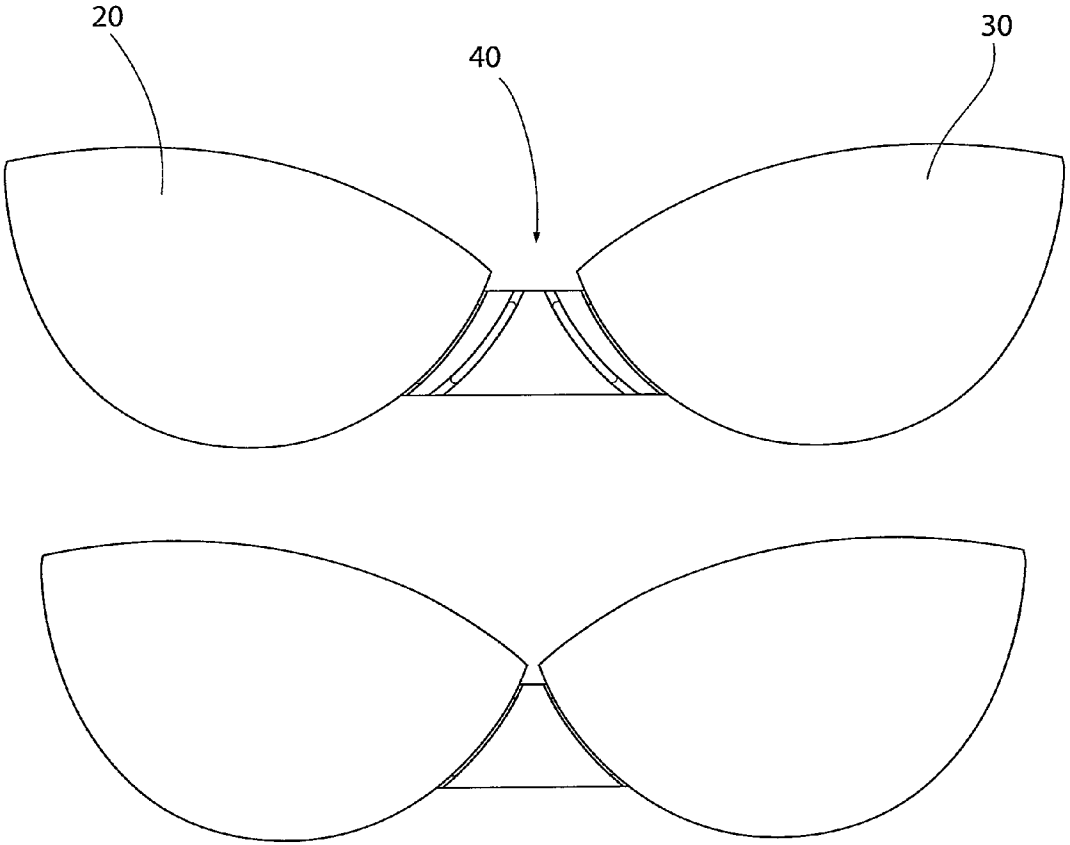
FIG. 7 is a perspective view showing a third embodiment of the apparatus of the present invention.
Figure 8:
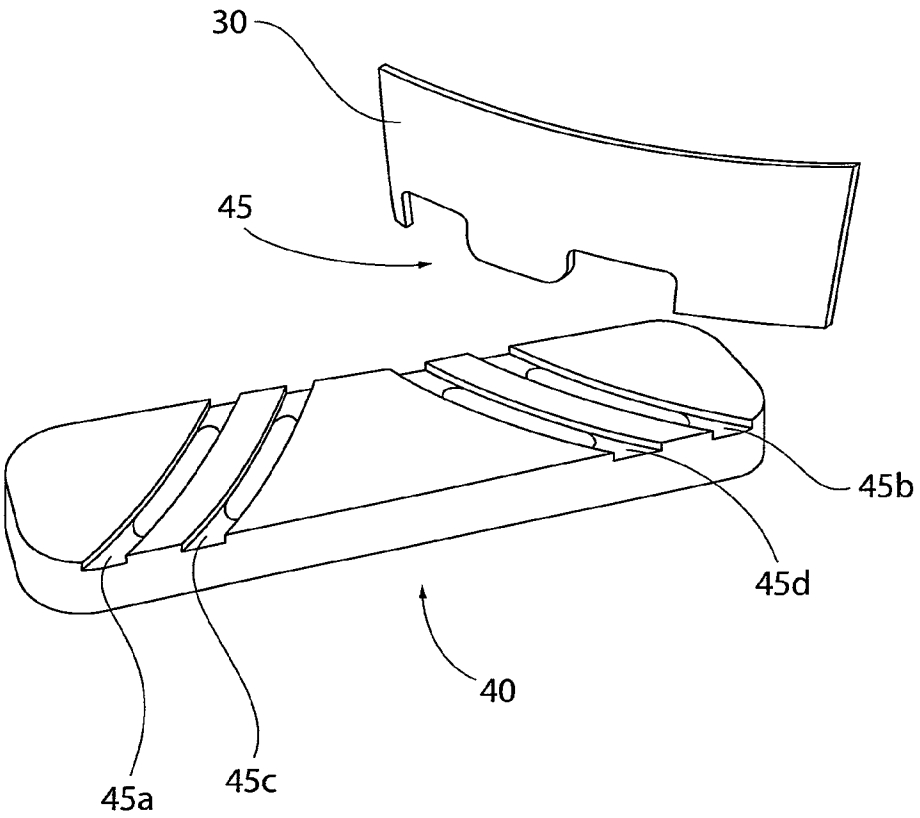
FIG. 8 is a perspective view showing the connecting member of the third embodiment.

In another non-limiting embodiment, shown in FIGS. 7-8, connecting member 40 can be a single elongated member which connects to first cup 20 and/or second cup 30. In such an arrangement, first cup 20 can include a connecting member engagement portion 35 formed along peripheral edge 26. Connecting member engagement portion 35 is designed to engage with connecting member 40. In some non-limiting embodiments, connecting member engagement portion 35 can include a set of grooves with a tab there between, as shown in FIG. 8. Connecting member engagement portion 35 should be designed such that, when connecting member 40 is engaged with first cup 20, the bottom of connecting member 40 is on a common plane with peripheral edge 26. This allows peripheral edge 26 of first cup 20 to remain flat against a surface. Other configurations are envisioned, provided that connecting member engagement portion 35 can engage with the connecting member 40.

In this embodiment, connecting member 40 can include one or more cup engagement portions 45. Cup engagement portions 45 are each designed to engage with engagement section 35 of first cup 20 or second cup 30 to establish the connection between connecting member 40 and first cup 20 or second cup 30. Preferably, connecting member 40 includes at least two cup engagement portions 45*a-b*, at least one of which is designed to engage engagement section 35 of first cup 20 and at least one of which is designed to engage engagement section 35 of second cup 30. The shape of each cup engagement portion 45 is not intended to be limited provided it complements the shape of engagement section 35. In one non-limiting embodiment, cup engagement section 45 is a groove or slot in connecting member 40 which accepts a corresponding tab of engagement section 35. The shape of cup engagement section 45 and engagement portion 35 can also be designed as a snap-fit arrangement to prevent the connecting member 40 from easily disengaging from cup. In some non-limiting embodiments, connecting member can include more than one engagement portion 45 for each engagement section 35. For instance, as shown in FIG. 8, connecting member 40 can have four cup engagement portions 45*a-d*, two of which are designed to engage with the engagement section 35 of first cup 20 and two of which are designed to engage with engagement section 35 of second cup 30. By including multiple sets of cup engagement portions 45, the space between first cup 20 and second cup 30 can be adjusted. For example, to position first cup 20 and second cup 30 closer to one another, the innermost cup engagement portions 45*c-d* can be used. In another arrangement, one inner cup engagement portion 45*d* can be used for second cup 30 while an outer cup engagement portion 45*a* can be used with first cup 30. In yet another arrangement, both outermost cup engagement portions 45*a-b* can be used. Each of these arrangements results in first cup 20 being a different distance from second cup 30.

The ability to control the spacing between first cup 20 and second cup 30 provides certain advantages. For instance, if apparatus 10 is being used to hold brassieres, spacing first cup 20 and second cup 30 at different positions relative to one another allows apparatus 10 to more readily hold brassieres of different sizes. By way of another example, if apparatus 10 is being used within a drawer or other area of limited space, the ability to move first cup 20 and second cup 30 closer to one another can help ensure apparatus 10 fits within the limited area.

Also provided are methods of using apparatus 10 to display and/or store a garment. A preferred garment for use with apparatus 10 is a woman's brassiere. Such a garment is well known to include first and second cups connected to one another. In use, apparatus 10 can be configured by interconnecting first cup 20 and second cup 30 using connecting member 40. The thus configured apparatus 10 can then be placed in a desired location, such as within a drawer or suitcase, on a shelf, or on a display table or platform. A brassiere can then be positioned on apparatus 10 such that the first and second cups of the brassiere are placed upon the outer surface of first cup 20 and second cup 30, respectively. One or more additional brassieres can then be placed on top of the first brassiere if desired. In necessary, the space between first cup 20 and second cup 30 can be adjusted by adjusting the connecting member 40 consistent with the description provided above. When it is desired to disassemble apparatus 10, brassieres can be removed from apparatus 10, first cup 20 can optionally be disengaged from connecting member 40, second cup 30 can optionally be disengaged from connecting member 40, and device can be stored for future use. In some non-limiting embodiments, first cup 20 can be stacked onto second cup 30 to lessen the space apparatus 10 takes up for storage, provided at least one of first cup 20 and second cup 30 is hollow.

The apparatus 10 described herein can be packaged and sold as a kit of parts, with the kit including at least first cup 20, second cup 30, and connecting member 40.

The apparatus 10 described herein provides a means for storing garments, and particularly brassieres, in a manner that preserves the shape thereof. The apparatus 10 can also provide a convenient, economical, and easy to use display device for displaying brassieres for sale in a retail establishment. Further, apparatus 10 described herein can accommodate brassieres of different sizes through the use of a connecting member 40 which can vary the distance between first cup 20 and second cup 30.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements. For example, it is to be understood that the present invention contemplates that, to the extent possible, one or more features of any embodiment can be combined with one or more features of any other embodiment.

I/We claim:

1. A garment holding apparatus, comprising:

a first cup;

a second cup; and a connecting member interconnecting the first cup with the second cup and adjustable between at least a first position and a second position, wherein when the connecting member is in the first position, the first cup and the second cup are spaced from one another by a first distance, and when the connecting member is in the second position, the first cup and the second cup are spaced from one another by a second distance, wherein the connecting member comprises an elongated, generally flat tongue member integrally formed with the first cup and a groove member integrally formed with the second cup, wherein the tongue member is adapted to slide within the groove member to adjust the connecting member between the first position and the second position, wherein the groove member comprises a groove formed between a top side and a bottom side of the groove member, and wherein the tongue member comprises a top side, a bottom side, and a thickness extending between the top side and bottom side, wherein the entire thickness of the tongue member slides within the groove of the groove member.

2. The apparatus of claim 1, wherein, the groove member comprises a hinged portion adapted to pivot between a closed position and an open position about a hinge.

3. The apparatus of claim 2, wherein when in the closed position, the hinged portion forms a groove.

4. The apparatus of claim 1, wherein the groove member includes a plurality of notches and the tongue member includes at least one tab configured to engage the notches on the groove member.

5. The apparatus of claim 1, wherein the tongue member includes a plurality of notches and the groove member includes at least one tab configured to engage the notches on the tongue member.

6. The apparatus of claim 4, wherein a first notch corresponds to the first position of the connecting member and a second notch corresponds to a second position of the connecting member.

7. The apparatus of claim 5, wherein a first notch corresponds to the first position of the connecting member and a second notch corresponds to a second position of the connecting member.

8. The apparatus of claim 1, wherein the first cup and the second cup each have a polymeric or flocking material coated on at least a portion of an outer convex surface thereof.

9. The apparatus of claim 8, wherein the polymeric or flocking material is a material having a high coefficient of friction.

10. The apparatus of claim 1, wherein each of the first cup and the second cup are semispherical.

11. The apparatus of claim 1, wherein the first cup is configured as a mirror image of the second cup.

12. A method of holding a garment for storage or display, comprising:

positioning, at a storage or display location, a garment holding apparatus comprising a first cup, a second cup, and a connecting member interconnecting the first cup with the second cup and adjustable between at least a first position and a second position, wherein when the connecting member is in the first position, the first cup and the second cup are spaced from one another by a first distance, and when the connecting member is in the second position, the first cup and the second cup are spaced from one another by a second distance;

overlaying a first portion of the garment on an outer convex surface of the first cup; and overlaying a second portion of the garment on an outer convex surface of the second cup, wherein the connecting member comprises an elongated, generally flat tongue member integrally formed with the first cup and a groove member integrally formed with the second cup, wherein the tongue member is adapted to slide within the groove member to adjust the connecting member between the first position and the second position, wherein the groove member comprises a groove formed between a top side and a bottom side of the groove member, and wherein the tongue member comprises a top side, a bottom side, and a thickness extending between the top side and bottom side, wherein the entire thickness of the tongue member slides within the groove of the groove member.

13. The method of claim 12, further comprising, adjusting the connecting member from the first position to the second position either before or after the garment holding apparatus is positioned at the storage or display location.

14. The method of claim 12, wherein the garment is a brassiere, the first portion of the garment is a first cup of the brassiere, and the second portion of the garment is a second cup of the brassiere.

15. An apparatus for holding a brassiere, comprising:

a first semispherical cup;

a second semispherical cup; and a connecting member comprising an elongated, generally flat tongue member integrally formed with the first semispherical cup and a groove member integrally formed with the semispherical second cup, the groove member comprising a hinged portion adapted to pivot between a closed position and an open position about a hinge, wherein the connecting member interconnects the first semispherical cup with the second semispherical cup and is adjustable between at least a first position and a second position, and wherein when the connecting member is in the first position, the first semispherical cup and the second semispherical cup are spaced from one another by a first distance, and when the connecting member is in the second position, the first semispherical cup and the second semispherical cup are spaced from one another by a second distance, wherein the tongue member is adapted to slide within the groove member to adjust the connecting member between the first position and the second position, wherein the groove member comprises a groove formed between a to side and a bottom side of the groove member, and wherein the tongue member comprises a top side, a bottom side, and a thickness extending between the top side and bottom side, wherein the entire thickness of the tongue member slides within the groove of the groove member.

16. The apparatus of claim 15, wherein the groove member includes a plurality of notches and the tongue member includes at least one tab configured to engage the notches on the groove member, and wherein a first notch corresponds to the first position of the connecting member and a second notch corresponds to a second position of the connecting member.

* * * * *